US006518871B2

(12) United States Patent
Fennell

(10) Patent No.: US 6,518,871 B2
(45) Date of Patent: Feb. 11, 2003

(54) FUSEHOLDER REMOVER

(76) Inventor: Robert B. Fennell, 978 Shawnee Egypt Rd., Springfield, GA (US) 31329

( * ) Notice: Subject to any disclaimer, the term of this patent is extended or adjusted under 35 U.S.C. 154(b) by 141 days.

(21) Appl. No.: 09/742,297

(22) Filed: Dec. 22, 2000

(65) Prior Publication Data

US 2002/0011916 A1 Jan. 31, 2002

Related U.S. Application Data

(60) Provisional application No. 60/173,498, filed on Dec. 29, 1999.

(51) Int. Cl.[7] ..... H01H 71/10; H01H 85/042; B25B 23/16

(52) U.S. Cl. ..... 337/171; 337/169; 81/3.8

(58) Field of Search ..... 337/168–179; 200/50.07; 361/835; 81/3.8

(56) References Cited

U.S. PATENT DOCUMENTS 1,600,247 A * 9/1926 Robinson ..... 81/3.8
1,704,491 A * 3/1929 Thompson ..... 294/19.1
1,752,575 A * 4/1930 Roselle ..... 294/104
1,840,150 A * 1/1932 Bodendieck ..... 81/177.7
1,853,598 A * 4/1932 Birkenmaier ..... 81/3.8
2,379,433 A * 7/1945 Hemmerling ..... 29/273
2,824,190 A * 2/1958 Mikos ..... 218/155
2,890,313 A * 6/1959 Smith, Jr. et al. ..... 218/13
4,132,441 A * 1/1979 Watkins ..... 294/19.1
4,321,575 A * 3/1982 Koszewa et al. ..... 337/168
5,742,220 A * 4/1998 Scherer ..... 294/19.1

FOREIGN PATENT DOCUMENTS

JP 04045508 A * 2/1992 ..... H01F/40/06
JP 09117880 A * 5/1997 ..... B25J/1/00

* cited by examiner

*Primary Examiner*—Anatoly Vortman
(74) *Attorney, Agent, or Firm*—Jim Zegeer

(57) ABSTRACT

A hot stick switch head for a lineman's tool for safely and expeditiously removing and installing fuseholders having a tubular body and a mounting assembly from an overhead mounting comprising a base member having a downwardly depending attachment device for attachment to the end of a hot stick and an elevated slot member on the opposite end thereof for receiving an element of said mounting assembly, and a fusebody-receiving notch. A laterally projecting arm engages a fusebody anywhere along the length thereof an guides the fusebody into the fusebody-receiving notch in the base member. The notch and slot are shaped and juxtaposed relative to each other so that on vertical elevation of the lineman's tool, the fusebody is securely retained thereon while the fusebody is lifted out of the fusebody mounting.

13 Claims, 10 Drawing Sheets

FUSEHOLDER REMOVER

REFERENCE TO RELATED APPLICATION

The present application is the subject of my provisional application Ser. No. 60/173,498 filed Dec. 29, 1999 entitled FUSEHOLDER REMOVER.

BACKGROUND AND BRIEF DESCRIPTION OF THE INVENTION

In my U.S. Pat. Nos. 5,532,668 and 5,670,927 I disclose universal fuseholders and cutouts with built-in safety features in which a slot having a length L and a width W for engagement by the projecting arm of a lineman's hot stick switch enables safe and expedient fuseholder maintenance, particularly in high wind and strong conditions. In my U.S. Pat. No. 5,532,668 I provide an attachment for an adaptor which is adapted to be secured to a fuse tube with a slot for engagement of the projecting arm of a hot stick switch.

In my present invention, instead of providing a slot on the fusebody either by way of an attachment or by the cut-out switch construction itself, I have modified the hot stick switch head by providing a slot and notch on the hot stick switch head which enable easy use of the hot stick switch to safely remove fuseholders for servicing and replacement of fuseholders without injury to the alignment or line repair.

The invention is directed to a hot stick switch head for a lineman's tool for safely and expeditiously removing and installing fuseholders having a tubular body and a mounting assembly from an overhead mounting comprising a base member having a downwardly depending attachment swivel device and an elongated slot on the opposite end thereof for receiving an element of the mounting assembly, and a fusebody-receiving notch. The invention includes a laterally projecting arm for engaging a fusebody anywhere along the length thereof and guiding said fusebody into said fusebody-receiving notch in said base member. The notch and slot are shaped and juxtapositioned so that on vertical elevation of the lineman's tool, the fusebody is securely retained while the fusebody is lifted out of or lifted to the fusebody mounting.

Thus, the object of the invention is to provide an improved fuseholder remover system and method which is low in cost and does not require any modification or change to the fuseholder and is adaptable to a wide variety of manufactured fuseholders.

BRIEF DESCRIPTION OF THE DRAWINGS

The above and other objects, advantages and features of the invention will become more apparent when considered with the following specification and accompanying drawings wherein.

DESCRIPTION OF THE INVENTION

Figure 1A:
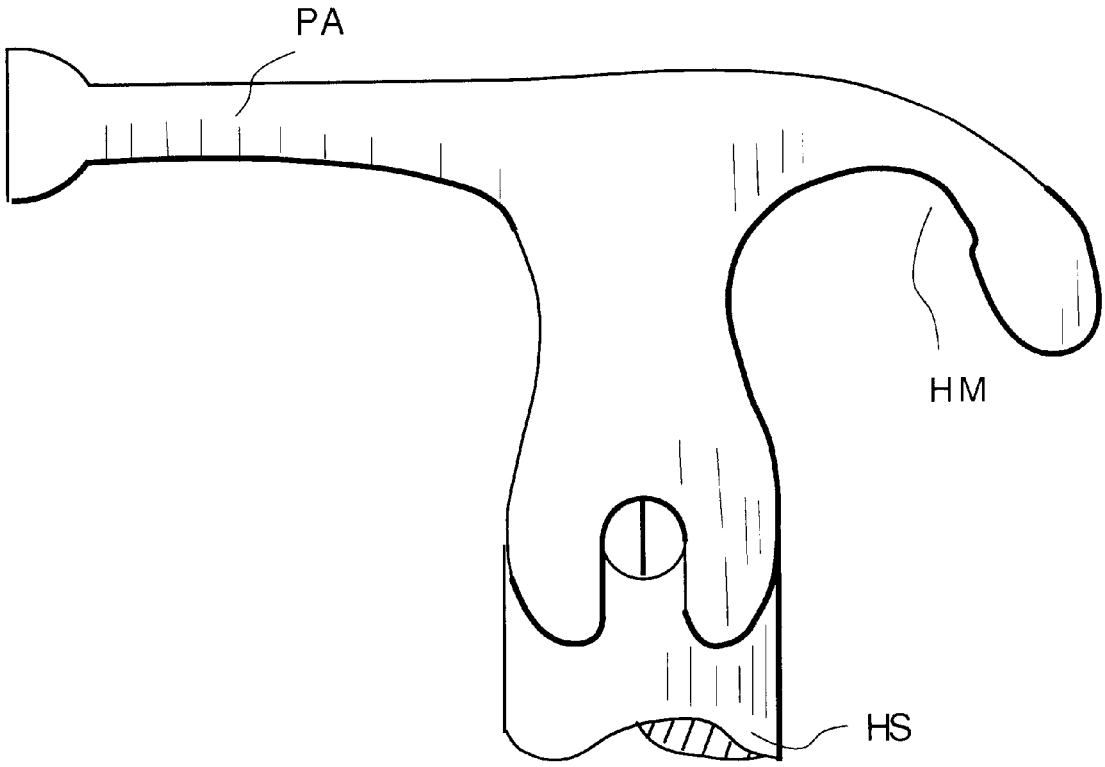
FIG. 1A (Prior Art)
FIG. 1A is a side elevational view of the current tool head with projecting arm PA for use on a hot stick switch. It is very easy for the fuseholder to fall off the disconnect tool and injure the lineman or repair person.
Figure 1B:
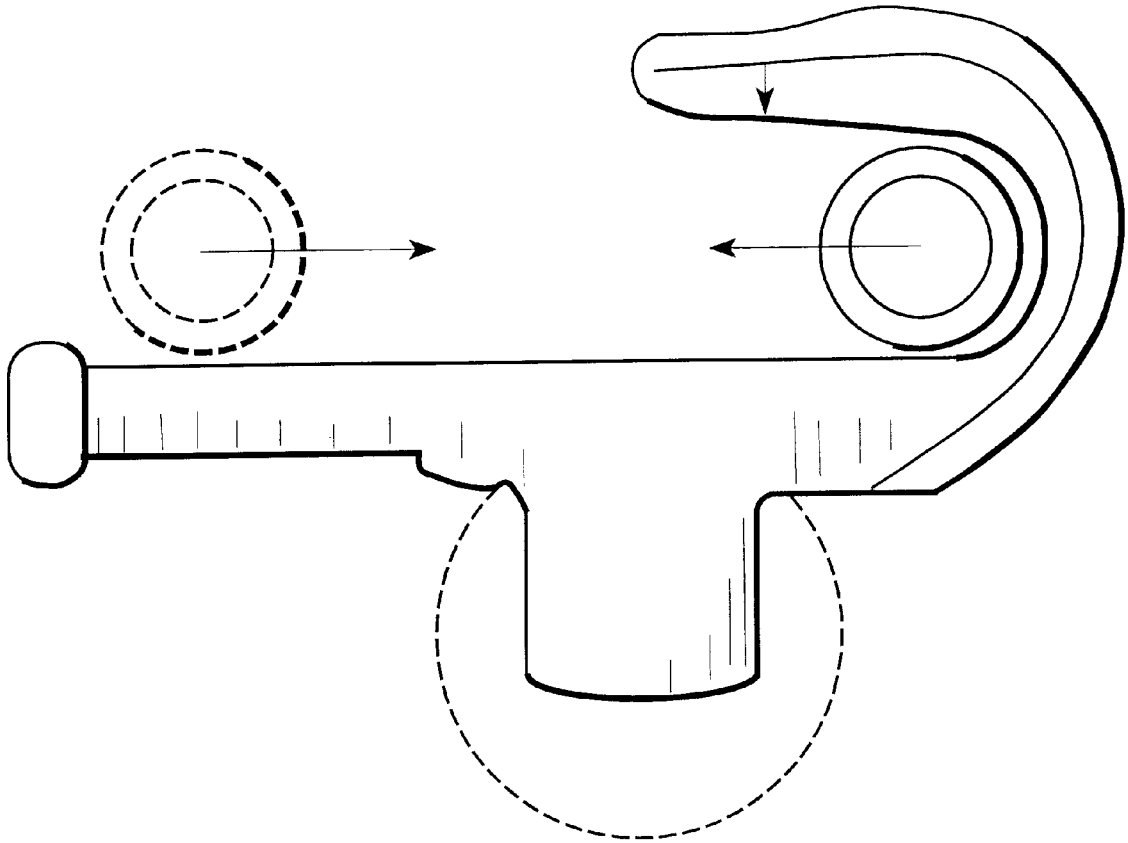
FIG. 1B is a view from my U.S. Pat. No. 5,532,668 which depicts a canted hook slot.
Figure 2:
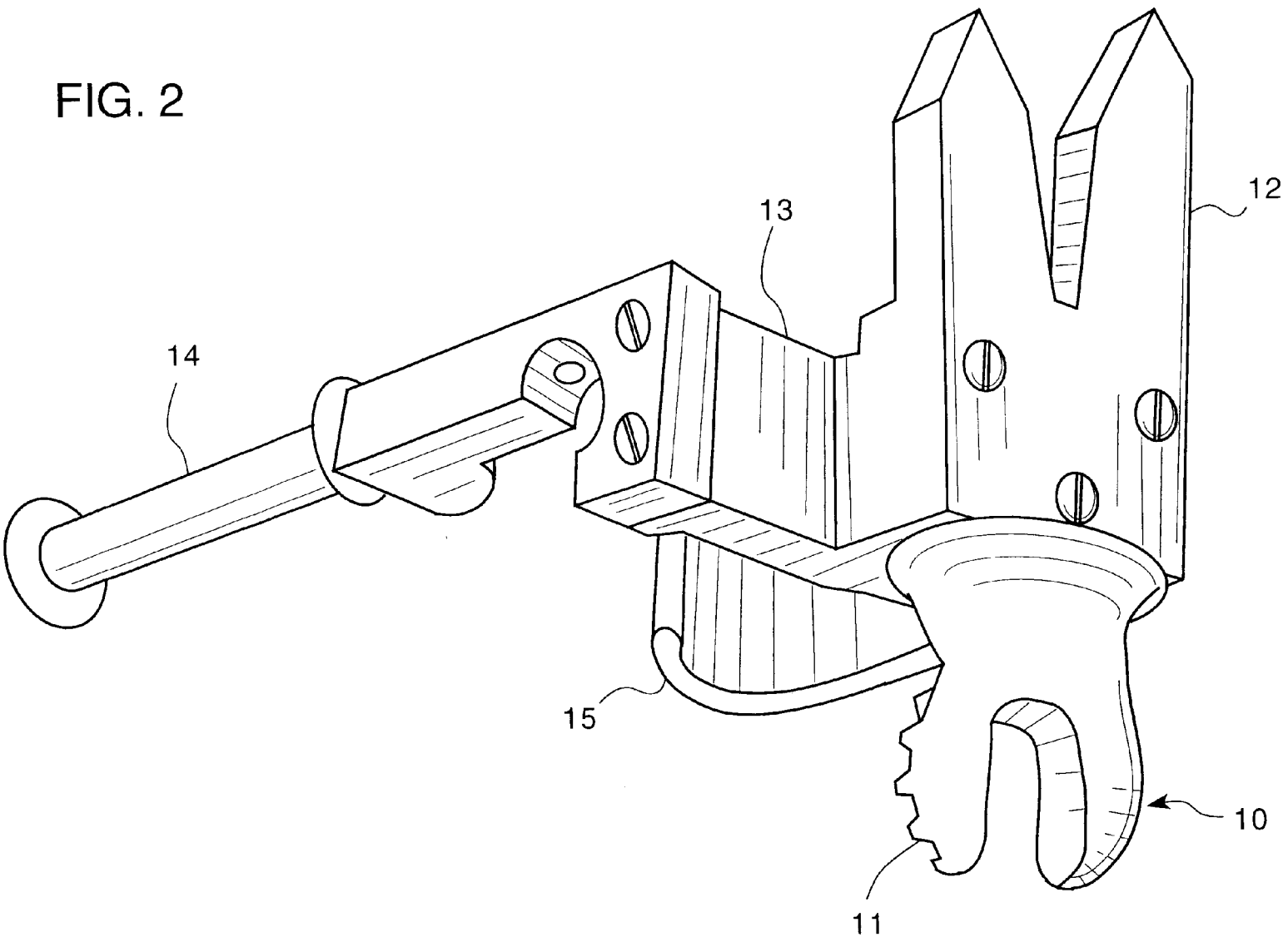
FIG. 2 is a perspective elevational view of the preferred embodiment of the lineman's hot stick switch head incorporating the present invention.
Figure 3:
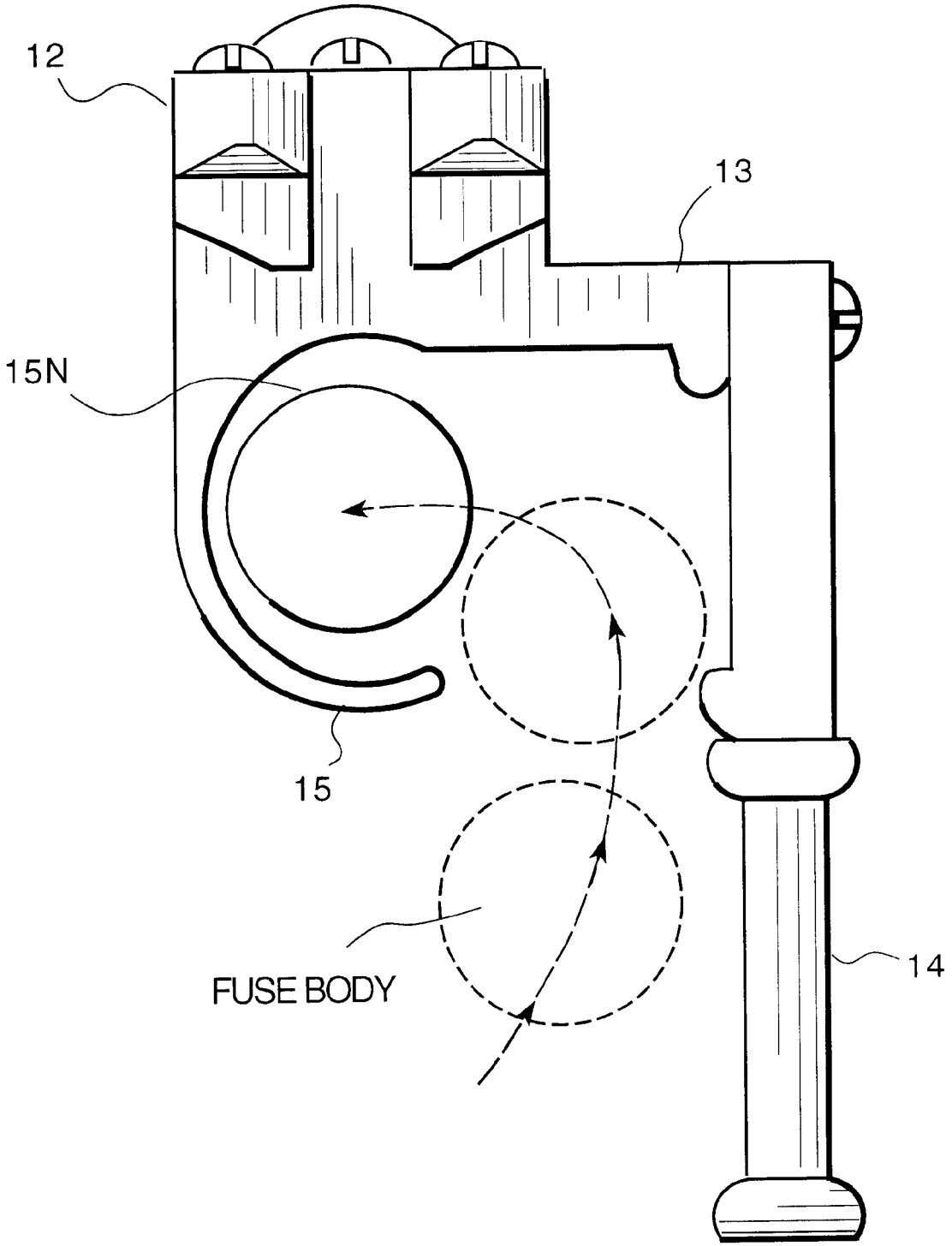
FIG. 3 is a top plan view of the embodiment shown in FIG. 2.
Figure 4:
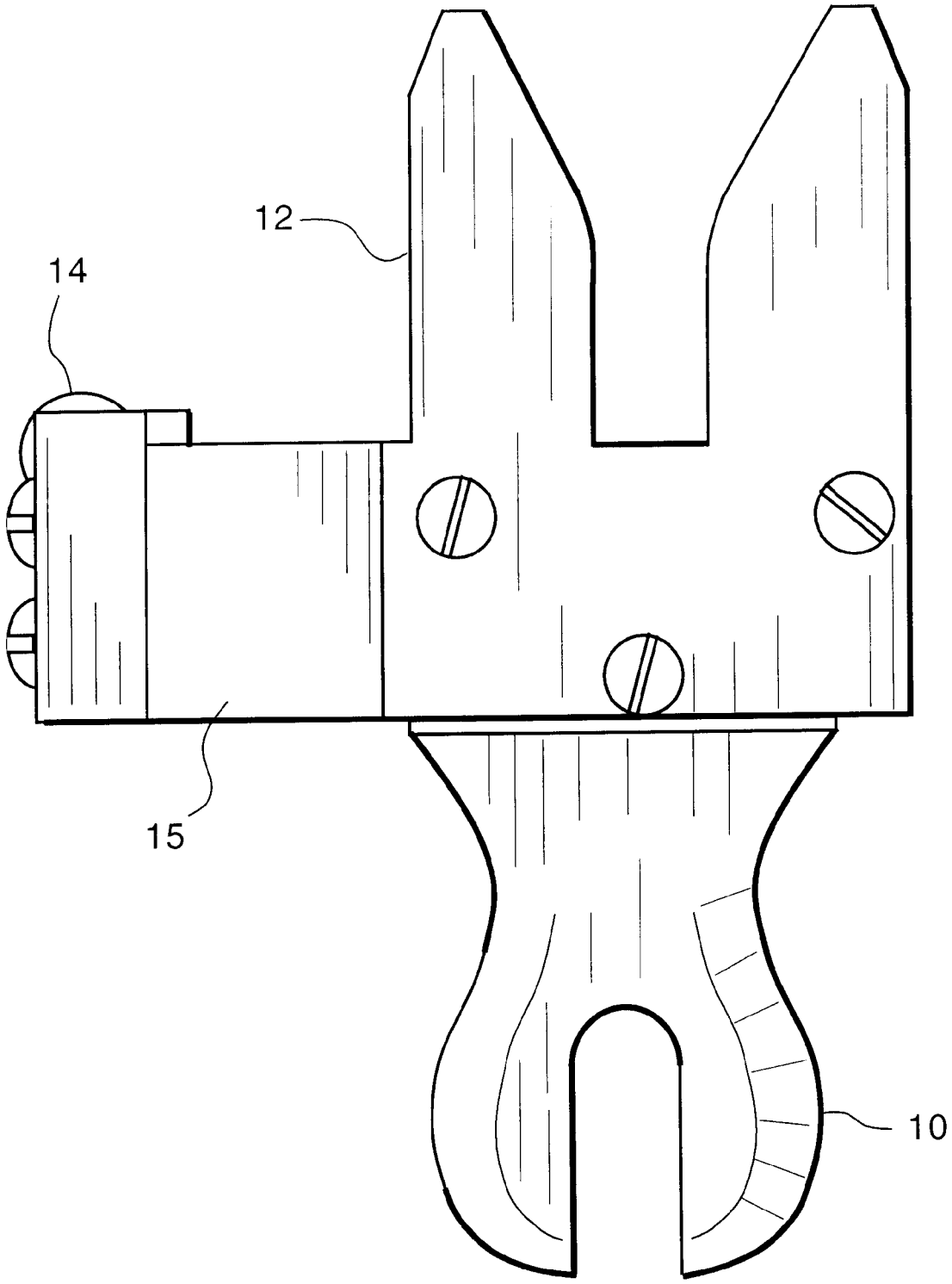
FIG. 4 is an end view of the embodiment shown in FIGS. 2 and 3.
Figure 5:
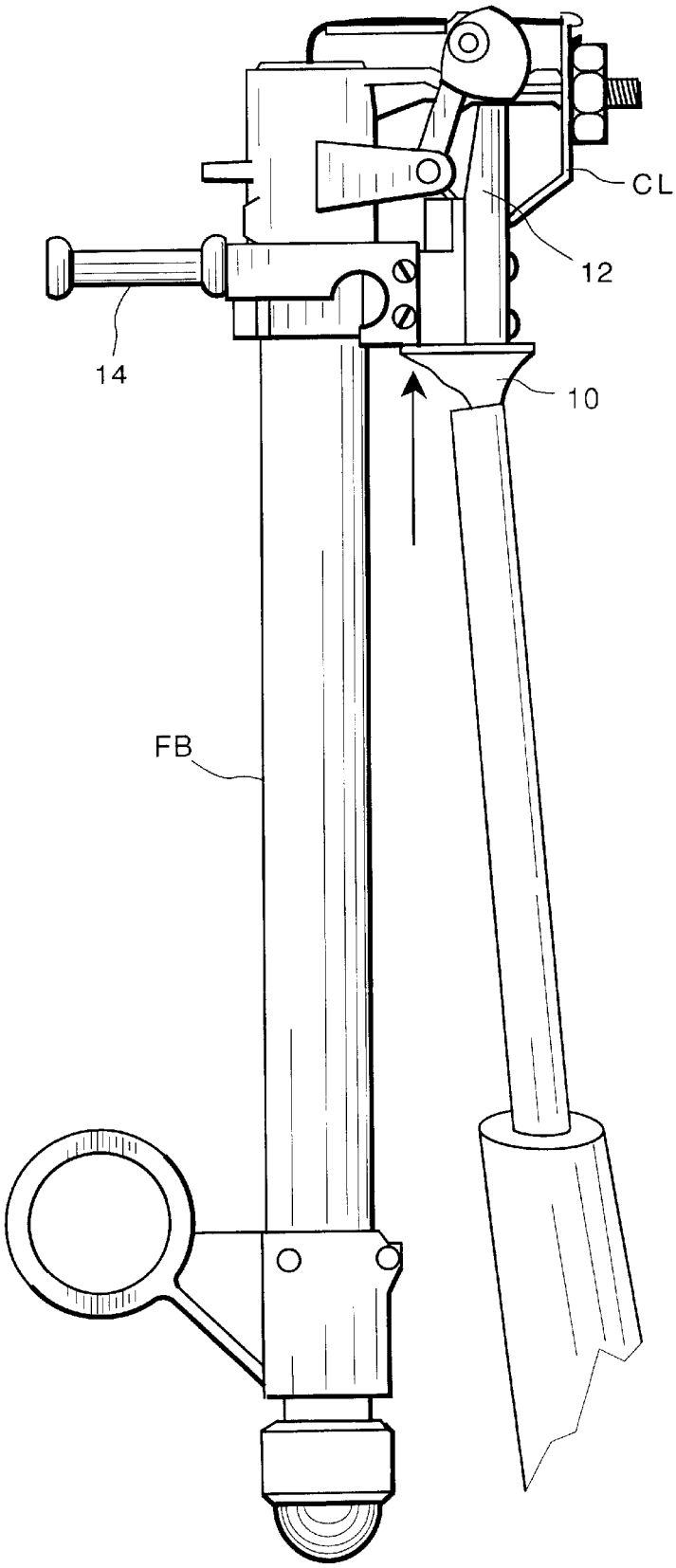
FIG. 5 is a side elevational view showing the projecting arm of the hot stick switch and new head assembly incorporating the invention and its easy and facile use in safely engaging and removing and replacing a above-ground distribution fuse cut-out switch.
Figure 6A:
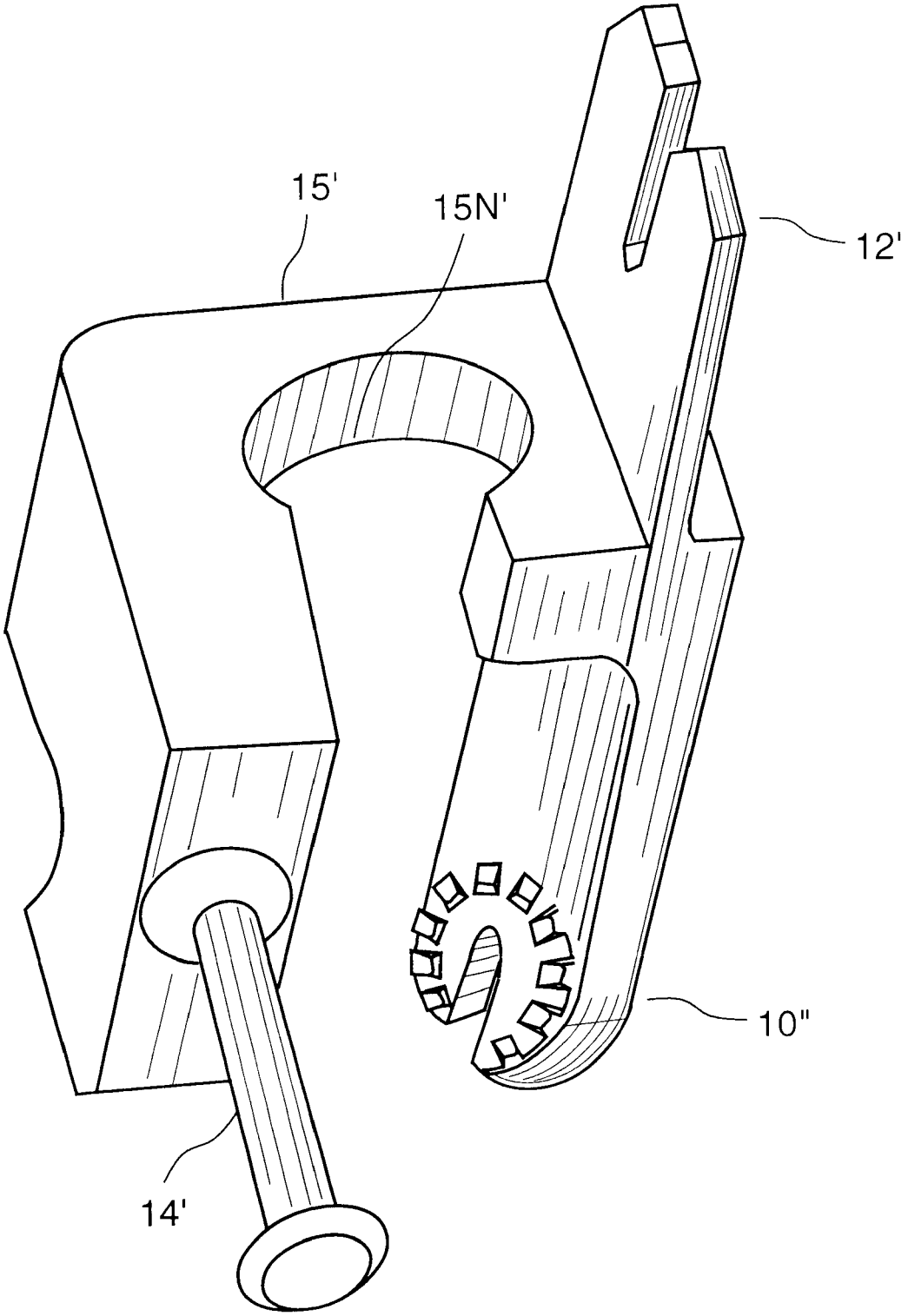
FIGS. 6A–6F illustrate a preferred embodiment of the invention.
Figure 6B:
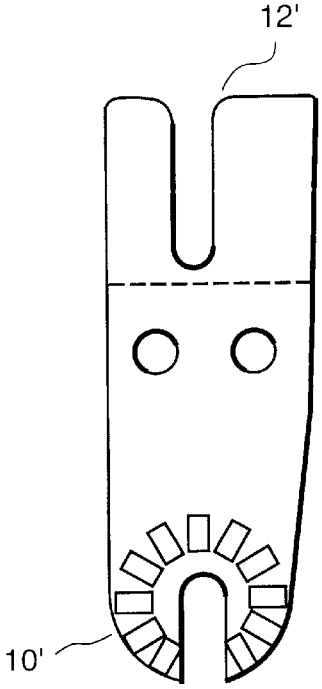
Figure 6C:
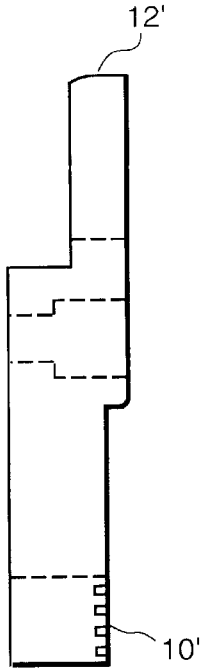
Figure 6D:
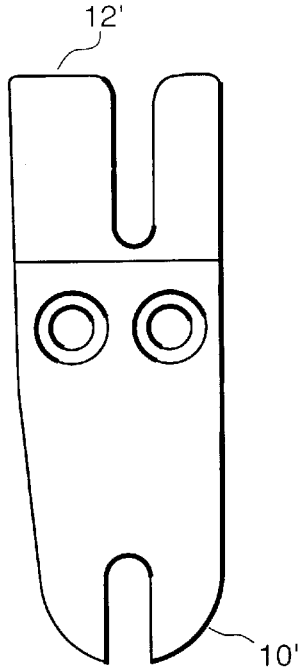
Figure 6E:
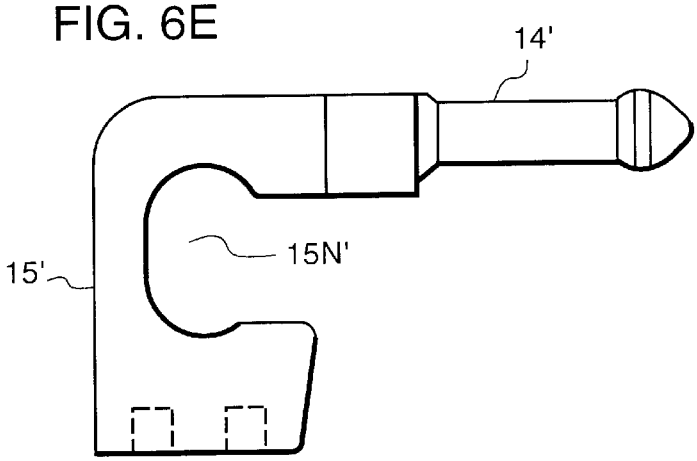
Figure 6F:
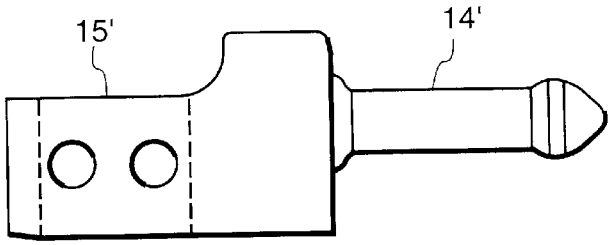

Referring to FIGS. 2, 3, 4 and 5, the hot stick switch head of a lineman's tool incorporating the invention has a base member 10 having a downwardly depending attachment swivel head 11 and an elongated V-slot member 12. Laterally projecting arm 13 has attached thereto a projecting arm 14 of a hot stick switch. Formed with the body of the head is a loop member 15 which forms a notch 15N for receiving the tubular fuse body FB, as shown in FIG. 3, in conjunction with V-slot member 12, is used to latch the fuse cut-out switch to the hot stick switch head. The V-slot member 12 is juxtaposed at an angle relative to notch 15N and projects upwardly to engage the clevis of the fusebody trunnion mechanism. In use, the projecting arm 14 is used to strike or engage the fusebody FB anywhere along the length of fusebody FB as indicated in FIG. 3. Thus, this avoids the necessity of the lineman on the ground having to fit the projecting arm of the conventional hot stick switch projecting arm PA (see FIG. 1) into trunnion portions of the fuse cut-out switch. He is provided with a much larger and more visible target, namely, the length of the fusebody itself in which to engage the fuse cut-out switch from twenty to thirty feet or more below on the ground. As indicated in the first dotted circle of FIG. 3, the fusebody is engaged by the projecting arm 14, and then the projecting arm 14 is used as a guide to guide the head 10 around the fusebody so that the fusebody is positioned in the solid line position as shown in FIG. 3. Then the head is moved vertically in the direction of the arrow by the lineman from below the ground so as to engage the long slot 12 with the clevis of the fusebody trunnion mechanism and lift the trunnions out of the trunnion sockets (not shown) and lower the fusebody to the ground. Due to the engagement of the slot 12 with a portion of the trunnion clevis and the engagement of the curved arm loop member or notch 15N about the fusebody, there is no possibility for the fuse cut-out switch to fall off of the head during raising or lowering of the fuse cut-out switch to the ground by the lineman.

It will be noted that in this preferred embodiment the projecting arm is offset laterally from the attachment portion of the head for attachment to the lineman's hot stick switch. The offset attends to the angle of the fusebody as it hangs in the trunnion sockets above ground.

In the preferred embodiment shown in FIGS. 6A–6F, the construction is essentially the same as shown in FIGS. 2, 3, 4 and 5 except that the parts are rearranged slightly for better manufacturability. While there is a three-part assembly shown in FIGS. 6A–6F (arm 14' is threadably joined to the notch member 15N'), they could be cast or molded as an integral unit, either as a casting (preferably aluminum alloy for light weight) as a fiberglass or other plastic components.

Figure 7:
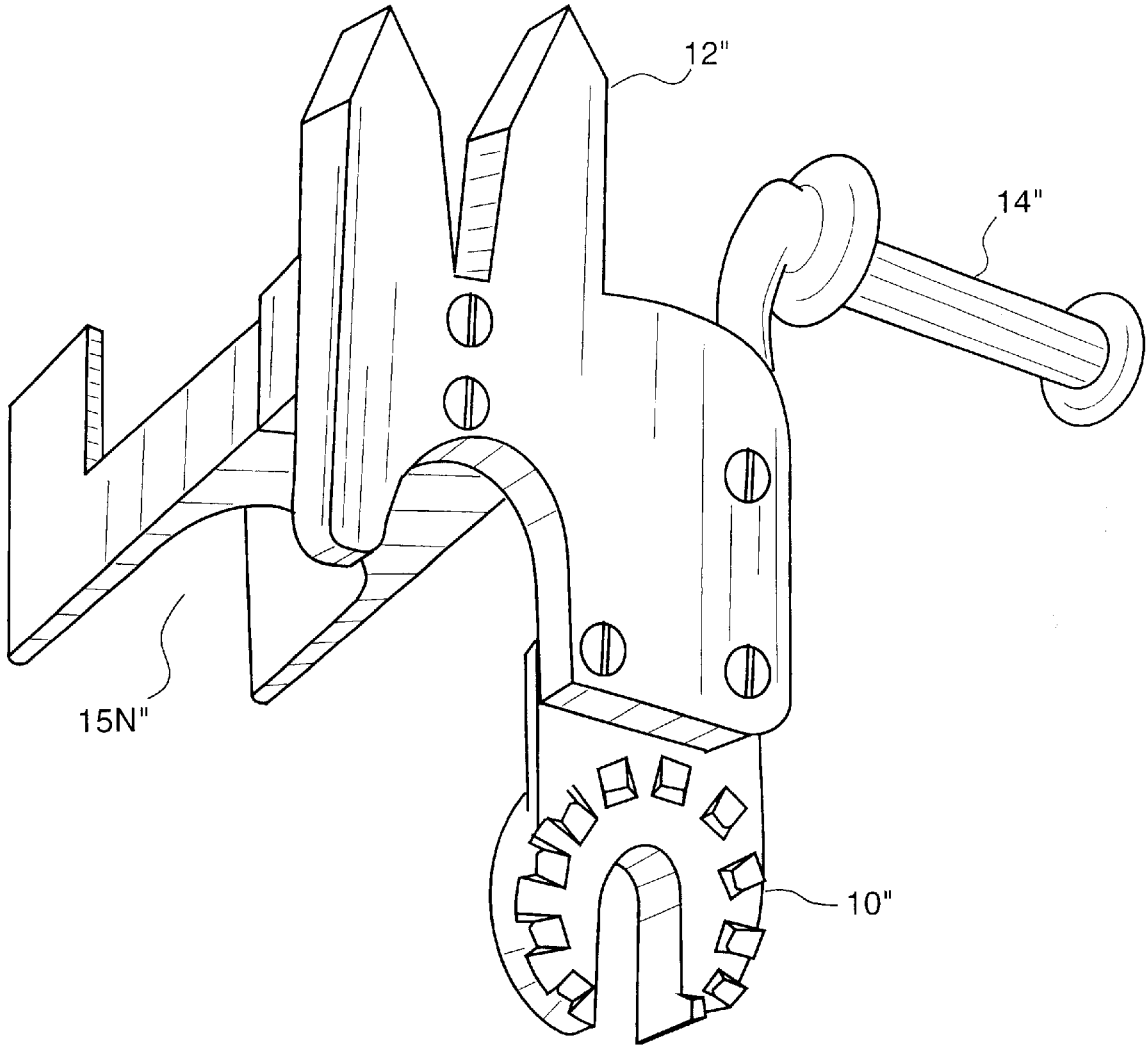
FIG. 7 is a perspective elevational view of a further embodiment of the invention.

The same offset concept is illustrated in FIG. 7 except in this embodiment, the projecting arms of the fusebody engaging component of the improved head engages the fusebody in a slightly different manner. It must be engaged directly from the ground, but it can be used to engage with the diverging fingers or arms to engage the head much more easily than engaging the eye by the projecting arm of the conventional lineman's switch stick.

Figure 8:
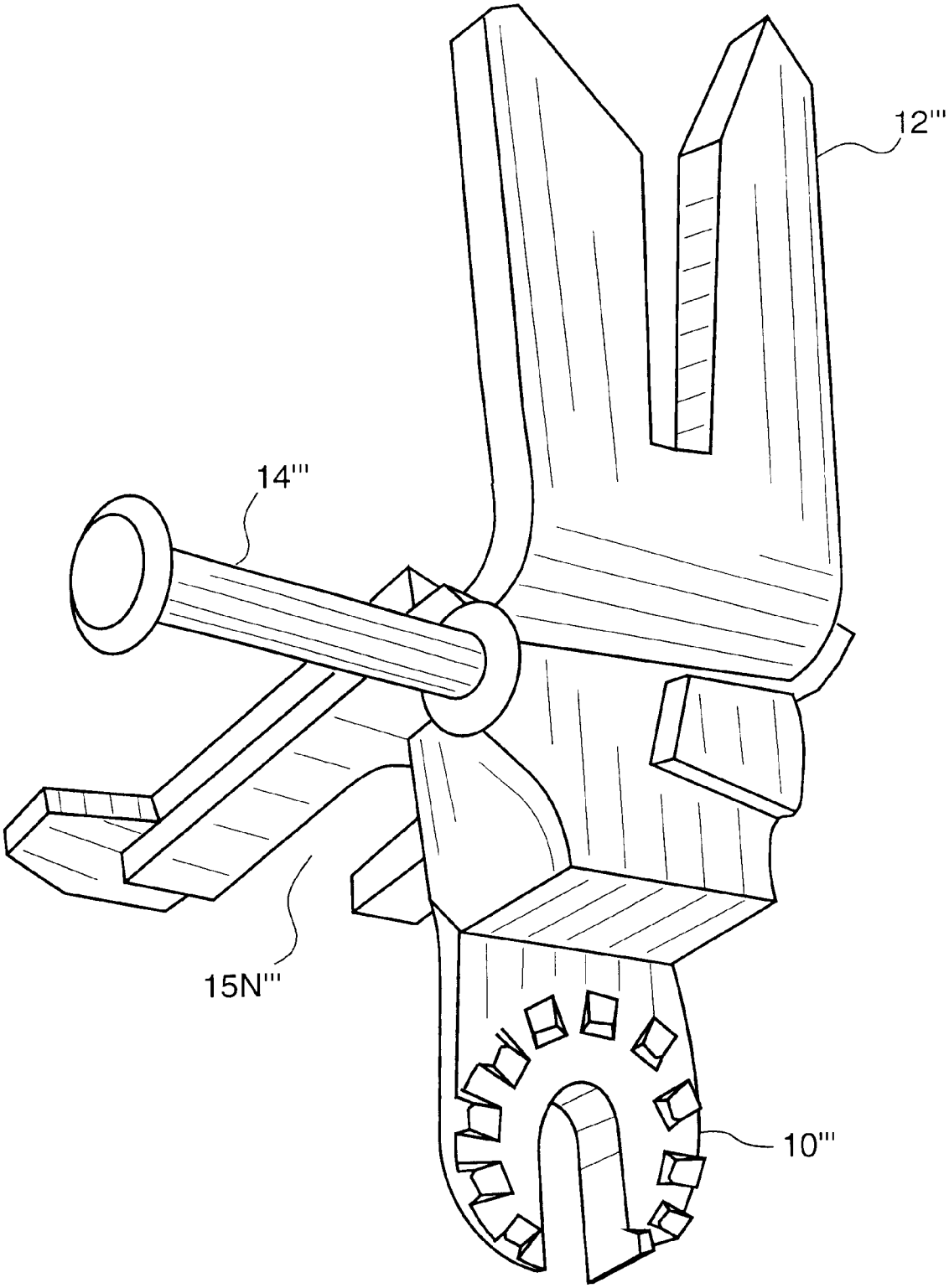
FIG. 8 is a perspective elevational view of a less preferred embodiment of the invention.

In the embodiment shown in FIG. 8, which is the least preferred embodiment, there is no offset of the fusebody engaging portion from the lineman's stick mounting member.

The fuseholder remover disclosed herein will remove all types of fuseholders (even old-type fuseholders). New-type fuseholders are taken out with the fork slot and fuseholder body. The new fuseholder remover will hook the fuseholder so that it does not fall off. The invention also provides an improved disconnect tool for the use on new type fuseholders, making it much safer to utilize.

The stick latch or mounting head rotates to align the button on the fiberglass stick and also rotates to avoid the wing nut from interfering with removal of the fuseholder.

The new fuseholder remover of this invention makes removing fuses faster and safer in rain and wind. The disconnect tool also acts as a guide as it guides the fuseholder into the fuseholder remover.

While the invention has been described in relation to preferred embodiments of the invention, it will be appreciated that other embodiments, adaptations and modifications of the invention will be apparent to those skilled in the art.

What is claimed is:

1. A hot stick switch head for a lineman's tool for safely and expeditiously removing and installing fuseholders having a tubular body and a mounting assembly from an overhead mounting comprising:

a base member having a downwwardly depending attachment device for attachment to an end of a hot stick and a slot member on the opposite end thereof for receiving an element of said mounting assembly, and a fusebody-receiving notch, a laterally projecting arm for engaging a fusebody anywhere along the length thereof and guiding said fusebody into said fusebody-receiving notch in said base member, said notch and slot being shaped and juxtaposed relative to each other so that on vertical elevation of said lineman's tool, said fusebody is securely retained while said fusebody is lifted out of said fusebody mounting.

2. The hot stick switch head defined in claim 1 wherein said attachment device is offset from said fusebody-receiving notch.

3. The hot stick switch head defined in claim 1 wherein said slot has a diverging mouth for orienting said element into said slot.

4. A hot stick switch head for a lineman's tool for safely and expeditiously removing and installing fuseholders having a tubular body and a mounting assembly from an overhead mounting comprising:

a base member having a downwwardly depending attachment swivel device for attachment to an end of said hot stick and an elongated slot having a diverging mouth on the opposite end thereof for receiving an element of said mounting assembly, and a fusebody-receiving notch, a laterally projecting arm for engaging a fusebody anywhere along the length thereof and guiding said fusebody into said fusebody-receiving notch in said base member, said notch and slot being shaped and juxtaposed relative to each other so that on vertical elevation of said lineman's tool, said fusebody is securely retained while said fusebody is lifted out of said fusebody mounting.

5. The hot stick switch head defined in claim 1 wherein said slot is V-shaped.

6. The hot stick switch head defined in claim 1 wherein said overhead mounting includes trunnion sockets, said projecting arm is offset laterally from said attachment portion of said hot stick switch head, said offset attending to the angle of the fusebody as it hangs in said trunnion sockets.

7. A hot stick switch head for a lineman's tool for expeditiously removing and installing fuseholders having a tubular body and a mounting assembly from an overhead mounting comprising: a base member having a laterally projecting arm, a notch for receiving a fusebody and a member having a slot therein for engaging said mounting assembly, said notch and member being shaped in juxtaposition relative to each other such that on vertical elevation of the lineman's tool, the fusebody is securely retained thereon.

8. The hot stick switch head defined in claim 7, including a depending attachment member for attachment to the end of a hot stick.

9. The hot stick switch head defined in claim 7 wherein said slot is V-shaped.

10. A method of expeditiously removing fuseholders having a tubular fusebody and a mounting assembly from an overhead mounting, using a hot stick switch head on a lineman's tool, said hot stick switch head having a laterally projecting arm, a notch for receiving a fusebody and a slot, said method comprising the step of first engaging said fusebody with said laterally projecting arm, guiding said fusebody into said notch, and then vertically moving said hot stick switch head so as to engage said slot with said mounting assembly, lifting said fusebody out of said overhead mounting, and lowering said fusebody for servicing at ground level.

11. The method defined in claim 10 including the step of replacing a fusebody on an overhead mounting comprising the steps of placing said fusebody in said notch, raising said hot stick switch head until said slot engages said mounting assembly, elevating said fusebody to seek said overhead mounting, and then lowering said hot stick switch head to disengage said hot stick switch head from said fusebody.

12. A hot stick switch head to remove and install fuseholders having a fusebody and a mounting assembly by a lineman using a hot stick when the hot stick switch head is connected thereto, the hot stick switch head comprising:

a base member adapted to be attached to a hot stick and having a slot member adapted to receive an element of a mounting assembly of a fuseholder therein when attached to the hot stick and positioned adjacent the element of the mounting assembly by a lineman;

a fusebody-receiving notch connected to the base member and adapted to receive a fusebody of a fuseholder therein so that the receiving notch and the slot member operate in conjunction to retain the fuseholder on the hot stick switch head when raising or lowering the fuseholder by a lineman; and a projecting arm positioned adjacent the receiving notch and adapted to engage the fusebody and to guide the fusebody into the receiving notch.

13. A hot stick switch head adapted to connect to a lineman's tool to remove and install fuseholders having a fusebody and a mounting assembly from an overhead mounting, the hot stick switch head comprising:

a base member having an attachment device extending in a first direction and adapted to be attached to a hot stick and a slot member having a substantially V-shaped slot and extending in a second direction opposite to the first direction and adapted to receive an element of a mounting assembly of a fuseholder therein when attached to the hot stick and positioned adjacent the element of the mounting assembly by a lineman;

a fusebody-receiving notch connected to the base member and adapted to receive a fusebody of a fuseholder therein, the fusebody-receiving notch including a curved arm loop member having an open region positioned to receive tubular portions of the fusebody so that the receiving notch and the slot member operate in conjunction to securely retain the fuseholder on the hot stick switch head when raising or lowering the fuseholder by a lineman; and a projecting arm positioned adjacent and extending outwardly from the receiving notch and adapted to engage the fusebody along a length thereof and to guide the fusebody into the curved arm loop member when the hot stick switch head is attached to the hot stick and is positioned adjacent the fusebody.

* * * * *